US012742576B2

(12) United States Patent
Hu

(10) Patent No.: US 12,742,576 B2
(45) Date of Patent: Sep. 22, 2026

(54) EJECTOR AND REFRIGERATION SYSTEM HAVING THE SAME

(71) Applicant: Carrier Corporation, Palm Beach Gardens, FL (US)

(72) Inventor: Guohong Hu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 98 days.

(21) Appl. No.: 18/660,913

(22) Filed: May 10, 2024

(65) Prior Publication Data

US 2024/0393022 A1 Nov. 28, 2024

(30) Foreign Application Priority Data

May 22, 2023 (CN) ..... 202310580269.0

(51) Int. Cl.
*F25B 41/30* (2021.01)

(52) U.S. Cl.
CPC ..... *F25B 41/30* (2021.01); *F25B 2341/0012* (2013.01)

(58) Field of Classification Search
CPC .... F25B 41/30; F25B 2341/0012; F25B 1/00; F04F 5/461; F04F 5/16; B05B 7/00; B05B 7/0416
USPC ..... 62/527, 500; 417/172, 183, 184, 185, 417/187, 189
See application file for complete search history.

(56) References Cited

U.S. PATENT DOCUMENTS

| | | | | |
|---|---|---|---|---|
| 4,595,344 | A * | 6/1986 | Briley | F04F 5/48 417/189 |
| 7,789,325 | B2 | 9/2010 | O'Brien | |
| 11,131,326 | B2 * | 9/2021 | Kawashima | F04F 5/20 |
| 11,156,234 | B2 * | 10/2021 | Lucas | H01M 8/04097 |
| 2003/0213264 | A1 * | 11/2003 | Ogata | F25B 41/00 62/191 |
| 2004/0172966 | A1 * | 9/2004 | Ozaki | F25B 9/008 62/500 |

(Continued)

FOREIGN PATENT DOCUMENTS

| | | | | |
|---|---|---|---|---|
| CN | 115013367 | A * | 9/2022 | F04F 5/16 |
| EP | 3315879 | A1 * | 5/2018 | F25B 49/02 |

(Continued)

OTHER PUBLICATIONS

CN-115013367-A, machine translation (Year: 2025).*
Extended European Search Report received for EP Application No. 24175780.6, mailed on Oct. 28, 2024, 4 pages.

*Primary Examiner* — Eric S Ruppert
*Assistant Examiner* — Kirstin U Oswald
(74) *Attorney, Agent, or Firm* — Drew Folgmann

(57) ABSTRACT

An ejector comprises: a housing having a first chamber and a second chamber, the first chamber having a first inlet for introducing high-pressure fluid and a second inlet for introducing low-pressure fluid, and the second chamber is sequentially provided with a reducing section, a mixing section, and an expanding section along the direction of fluid movement; a nozzle installed in the first chamber of the housing and is only capable of moving along the axis direction of the first chamber of the housing; a magnetic rotating mechanism, comprising an outer ring and an inner ring, the inner ring is rotatably connected to the second end of the nozzle.

20 Claims, 8 Drawing Sheets

(56) References Cited

U.S. PATENT DOCUMENTS

| | | | | |
|---|---|---|---|---|
| 2005/0155374 | A1* | 7/2005 | Oshitani | F25B 41/00 62/500 |
| 2005/0188719 | A1* | 9/2005 | Sugiura | F25B 41/00 62/500 |
| 2009/0295170 | A1* | 12/2009 | Tell | F04F 5/52 290/1 A |
| 2009/0311111 | A1* | 12/2009 | Yoshii | F04F 5/04 417/198 |
| 2012/0148421 | A1* | 6/2012 | Huntley | F04F 5/20 417/85 |
| 2016/0327319 | A1* | 11/2016 | Lozyniak | F25B 9/08 |
| 2017/0356683 | A1* | 12/2017 | Park | F25B 41/00 |
| 2018/0073523 | A1* | 3/2018 | Brunner | F04F 5/461 |
| 2018/0120004 | A1* | 5/2018 | Lee | F25B 41/00 |

FOREIGN PATENT DOCUMENTS

| | | | | |
|---|---|---|---|---|
| JP | 2005069599 | A * | 3/2005 | F25B 41/00 |
| JP | 2005282507 | A | 10/2005 | |
| JP | 2008139003 | A * | 6/2008 | F25B 41/00 |

* cited by examiner

EJECTOR AND REFRIGERATION SYSTEM HAVING THE SAME

CROSS REFERENCE TO A RELATED APPLICATION

The application claims the China Patent Application No. 202310580269.0 filed May 23, 2023, the contents of which are hereby incorporated in their entirety.

FIELD OF THE INVENTION

The present invention relates to the technical field of ejectors, in particular to an ejector, and further to a refrigeration system configured with the ejector.

BACKGROUND OF THE INVENTION

Ejector (also known as injector) is a component that can increase the pressure of the injected fluid without consuming electrical or mechanical energy. Due to its small size, light weight, compact structure, and high efficiency, the ejector has gradually become an indispensable component in refrigeration systems. In traditional refrigeration systems, traditional components such as compressors, evaporators, condensers, and throttling devices are often used for refrigeration. With the continuous development of technology, the combination of ejectors and compressors for cooling has become an emerging refrigeration method. The nozzle, as the main component of the ejector, its installation position is very important. Under different operating conditions, there exists an optimal nozzle position for the ejector. If the distance from the nozzle outlet to the mixing chamber is too large or too small, it will lead to lower ejector efficiency, thereby affecting the power consumption of the compressor.

SUMMARY OF THE INVENTION

In view of the above, the present invention provides an ejector, so as to solve or at least alleviate one or more of the aforementioned problems and problems in other aspects existing in the prior art, or to provide an alternative technical solution for the prior art.

According to a solution of the present invention, an ejector is provided, comprising:

a housing having a first chamber and a second chamber, wherein the first chamber is provided with a first inlet for introducing high-pressure fluid and a second inlet for introducing low-pressure fluid, and the second chamber is sequentially provided with a reducing section, a mixing section, and an expanding section along the direction of fluid movement;

a nozzle installed in the first chamber of the housing and is only capable of moving along the axis direction of the first chamber of the housing, wherein the nozzle has a first end and a second end, the first end of the nozzle extends into the reducing section of the second chamber, the nozzle has a hollow structure for maintaining fluid communication with the first inlet, and the second inlet is located outside the outlet of the first end of the nozzle;

a magnetic rotating mechanism, comprising an outer ring and an inner ring concentrically arranged on the inner side of the outer ring, where the outer ring and the inner ring are installed at the housing in a rotatable manner around the axis of the first chamber of the housing, wherein the inner ring is rotatably connected to the second end of the nozzle, the outer surface of the inner ring and the inner surface of the outer ring are respectively provided with magnets with opposite magnetic properties and the same quantity, and an extending portion for sealing is provided between the inner ring and the outer ring, where the extending portion is fixedly connected to the housing; and a guiding mechanism arranged between the housing and the nozzle to prevent the nozzle from rotating around the axis of the first chamber of the housing;

wherein, when the outer ring of the magnetic rotating mechanism rotates, the magnetic field between the inner ring and the outer ring changes, and the inner ring rotates under the action of magnetic force, thereby driving the nozzle to move along the axis direction of the first chamber of the housing.

In an embodiment of an ejector according to the present invention, the guiding mechanism comprises:

a sliding groove arranged on a sidewall of the first chamber and extending along the axis direction of the first chamber;

a sliding body capable of moving along the sliding groove; and a recess arranged on an outer sidewall of the nozzle to partially accommodate the sliding body, wherein the shape of the recess matches the shape of a portion of the sliding body extending into the recess.

In another embodiment of an ejector according to the present invention, the sliding body is a ball, the recess has a hemispherical concave surface that matches the ball, and the sliding groove has a semi-circular cross-section; or the sliding body is a square block, the recess is a square groove that matches the block, and the sliding groove has a square cross-section; or the sliding body is a cylinder, the recess is a cylindrical groove that matches the cylinder, and the sliding groove has a semi-circular cross-section.

In yet another embodiment of an ejector according to the present invention, the inner surface of the outer ring is provided with first magnets and second magnets that are alternately connected in sequence, where the magnetic property of the first magnets is opposite to that of the second magnets, and the quantity of the first magnets and that of the second magnets are the same, which are at least two, respectively; and the outer surface of the inner ring is provided with third magnets and fourth magnets that are alternately connected in sequence, where the magnetic property of the third magnets is opposite to that of the fourth magnets, and the quantity of the third magnets and that of the fourth magnet are the same, which are at least two, respectively.

In still another embodiment of an ejector according to the present invention, the first magnets and the second magnets are fixed on the inner surface of the outer ring by bonding, riveting, or threaded connection, and the third magnets and the fourth magnets are fixed on the outer surface of the inner ring by bonding, riveting, or threaded connection.

In another embodiment of an ejector according to the present invention, the first magnet and the second magnet have the same size and shape, and the third magnet and the fourth magnet have the same size and shape.

In yet another embodiment of an ejector according to the present invention, the housing comprises a body and an end cover, where one side of the extending portion is fixedly connected to the body of the housing, and the other side of the extending portion is detachably fixed to the end cover of the housing.

In another embodiment of an ejector according to the present invention, the extending portion is provided with a sealant.

In yet another embodiment of an ejector according to the present invention, first retaining rings are respectively provided on both sides of the outer ring, where the first retaining ring comprises: a first annular body arranged between the outer ring and the housing; and a plurality of first balls fixed on the first annular body in a rotatable manner; and second retaining rings are respectively provided on both sides of the inner ring, where the second retaining ring comprises: a second annular body arranged between the inner ring and the housing; and a plurality of second balls fixed on the second annular body in a rotatable manner.

In still another embodiment of an ejector according to the present invention, the outer ring and the inner ring are made of aluminum alloy or magnesium alloy; and/or the housing is made of copper; and/or the nozzle is made of stainless steel.

In another embodiment of an ejector according to the present invention, the outer surface of the outer ring is provided with a gear, and the outer ring is maintained in transmission connection with an external motor through the gear.

In yet another embodiment of an ejector according to the present invention, the nozzle is provided with four openings for introducing high-pressure fluid, where the four openings are uniformly distributed around the circumference of the nozzle.

In still another embodiment of an ejector according to the present invention, the hollow structure of the nozzle has a reducing section and an expanding section near the first end.

In another embodiment of an ejector according to the present invention, the inner ring is in threaded connection with the second end of the nozzle.

In addition, according to a solution of the present invention, a refrigeration system configured with the aforementioned ejector is also provided.

It can be appreciated that the ejector of the present invention can adapt to different operating conditions by adopting an adjustable nozzle. Under high-pressure conditions, the distance between the nozzle end and the mixing chamber can be increased, while under low-pressure conditions, the distance between the nozzle end and the mixing chamber can be reduced. In this way, when the operating conditions change, the nozzle remains in the optimal position to maintain stable operation of the system.

BRIEF DESCRIPTION OF THE DRAWINGS

The technical solution of the present invention will be described in further detail below in conjunction with the accompanying drawings and embodiments. However, it should be noted that these drawings are only designed for explanatory purposes and are intended to conceptually illustrate the structure described herein, without the need to be drawn proportionally.

DETAILED DESCRIPTION OF EMBODIMENT(S) OF THE INVENTION

Figure 1:
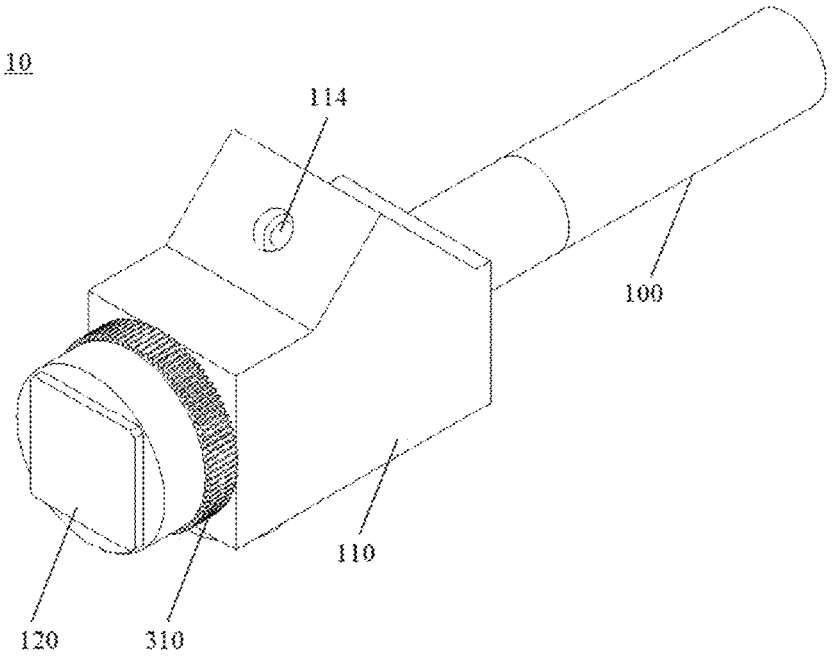
FIG. 1 illustrates an exemplary structural diagram of an embodiment of an ejector according to the present invention.

The content of the present invention and the differences between the present invention and the prior art can be understood by referring to the accompanying drawings and the text. The technical solution of the present invention will be described in further detail below through the accompanying drawings and by enumerating some optional embodiments of the present invention. The same or similar reference numerals in the drawings represent the same or similar components.

It should be noted that any technical features or solutions in the embodiments are one or several of multiple optional technical features or technical solutions. For brevity, it is neither possible to exhaustively enumerate herein all alternative technical features and technical solutions of the present invention, nor is it possible to emphasize that the implementation mode of each technical feature is one of the optional multiple implementation modes. Therefore, those skilled in the art should be aware that any technical means provided by the present invention can be substituted, or any two or more technical means or technical features provided by the present invention can be combined with each other to obtain a new technical solution.

Any technical feature or technical solution within the embodiments does not limit the scope of protection of the present invention. The scope of protection of the present invention should include any alternative technical solutions that those skilled in the art can think of without creative labor, as well as any new technical solutions obtained by those skilled in the art by combining any two or more technical means or technical features provided by the present invention.

Those skilled in the art are aware that the ejector uses the Venturi effect to increase the pressure energy of the fluid at the inlet of the ejector by virtue of the dynamic fluid supplied to the dynamic inlet of the ejector. As a result, the ejector can be arranged in the refrigeration system to cause the refrigerant to do work. For example, the ejector is configured to use high-pressure refrigerant from the condenser to inject low-pressure refrigerant from the evaporator and mix them into a medium pressure gas-liquid two-phase refrigerant.

FIG. 1 schematically illustrates the structure of an embodiment of an ejector according to the present invention in general. In conjunction with FIGS. 2 to 5, an ejector 10 is composed of a housing 100, a nozzle 200, a magnetic rotating mechanism 300, a guiding mechanism 400, and other components. The body 110 of the housing 100 has a first chamber 111 and a second chamber 112, wherein the axis of the first chamber 111, the axis of the second chamber 112, and the axis of the nozzle 200 are the same. The first chamber 111 is provided with a first inlet 113 (also known as a dynamic inlet) for introducing high-pressure fluid and a second inlet 114 (also known as a suction inlet) for introducing low-pressure fluid. The second chamber 112 is sequentially provided with a reducing section 112*a*, a mixing section 112*b* (also known as a mixing chamber), and an expanding section 112*c* along the direction of fluid movement. The high-pressure fluid entering from the first inlet 113 and the low-pressure fluid entering from the second inlet 114 converge at the reducing section 112*a*, and then undergo sufficient momentum and energy transfer in the mixing section 112*b*. The mixed airflow is pressurized through the expanding section 112*c* and discharged from the end of the ejector 10 into a compressor (not shown).

Figure 2:
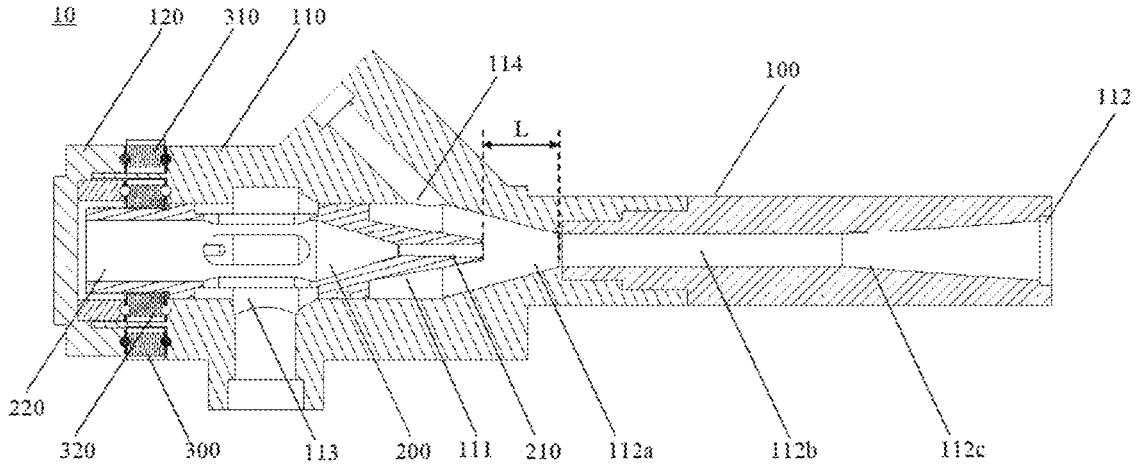
FIG. 2 illustrates an exemplary cross-sectional diagram of an ejector according to the present invention under high-pressure conditions.
Figure 3:
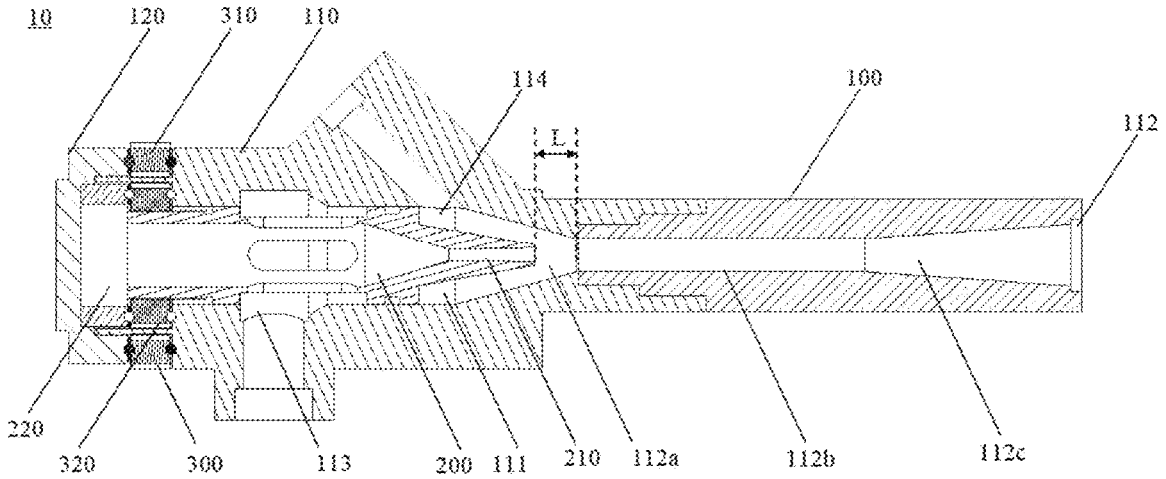
FIG. 3 illustrates an exemplary cross-sectional diagram of an ejector according to the present invention under low-pressure conditions.
Figure 4:
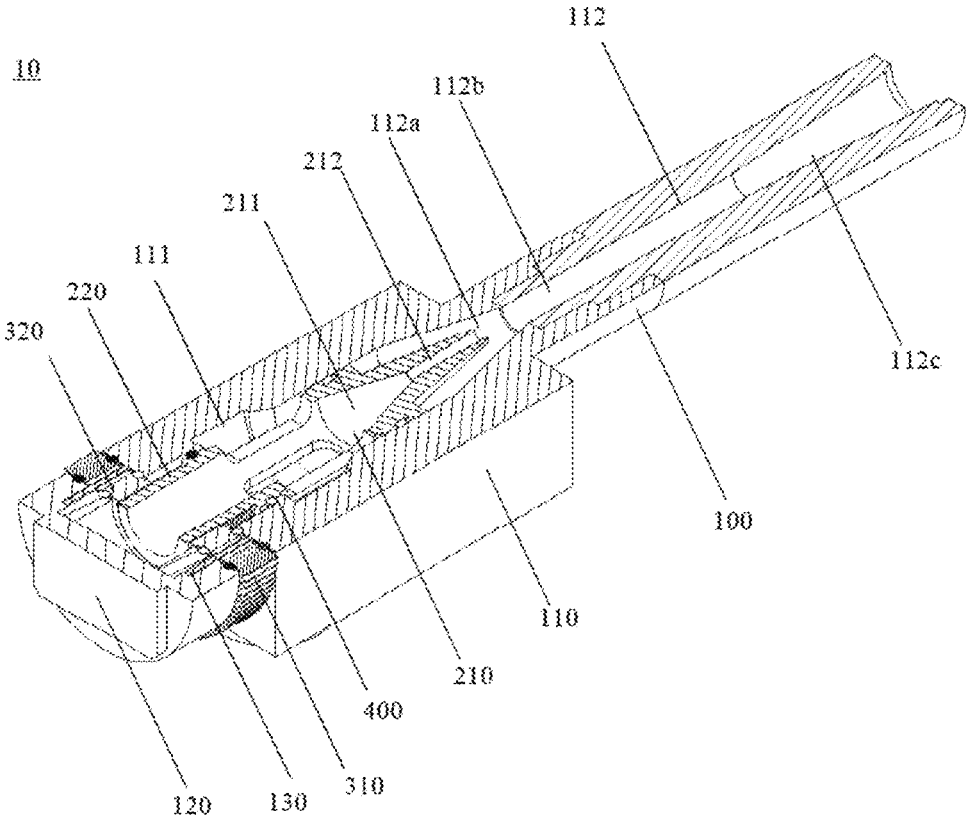
FIG. 4 illustrates an exemplary three-dimensional cross-sectional diagram of the ejector in FIG. 3.
Figure 5:
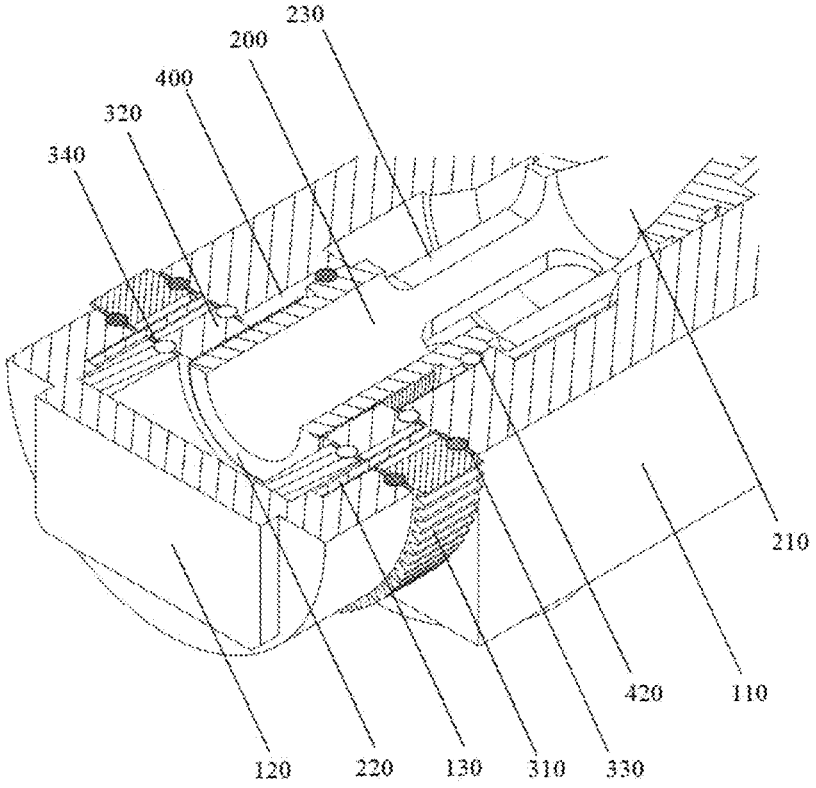
FIG. 5 illustrates an exemplary locally enlarged structural diagram of an ejector according to the present invention.
Figure 6:
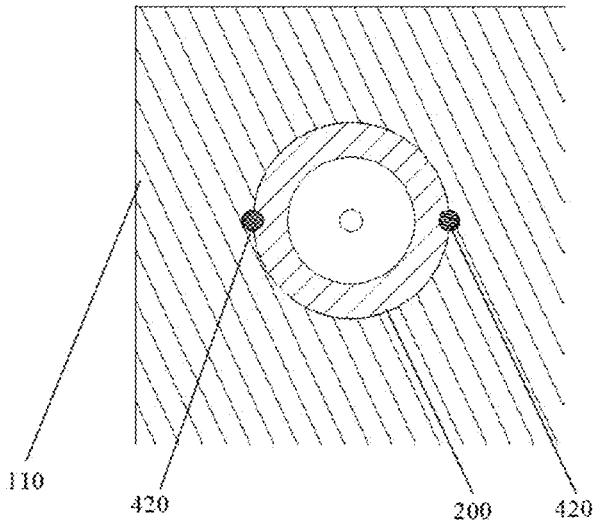
FIG. 6 illustrates an exemplary longitudinal cross-sectional diagram of an ejector according to the present invention at the guiding mechanism.
Figure 7:
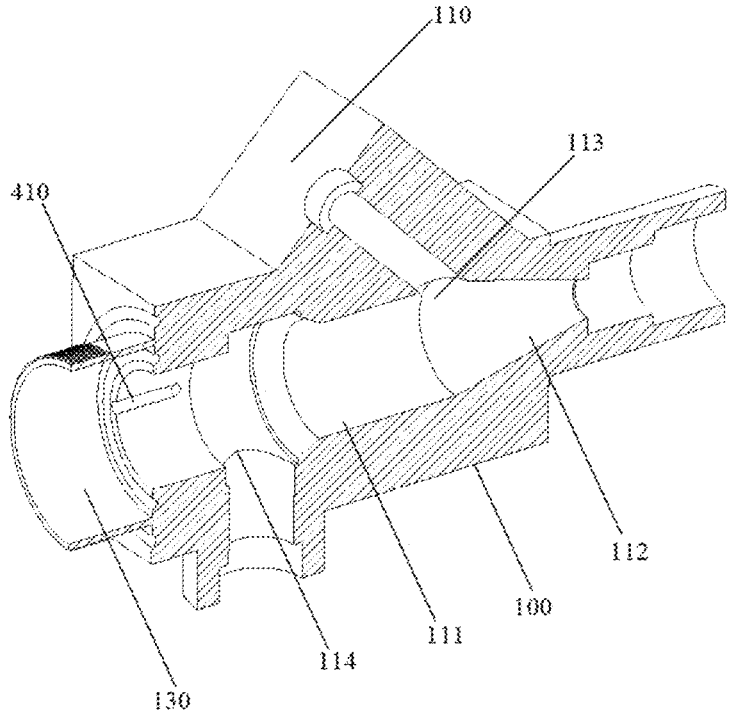
FIG. 7 illustrates an exemplary three-dimensional cross-sectional diagram of the body of the ejector housing according to the present invention.

As can be clearly seen from FIGS. 2 to 4, the nozzle 200 is installed in the first chamber 111 of the housing 100, and is capable of only moving along the axis direction of the first chamber 111 of the housing 100. The nozzle 200 has a first end 210 and a second end 220, where the first end 210 of the nozzle 200 extends into the reducing section 112*a* of the second chamber 112. The nozzle 200 has a hollow structure for maintaining fluid communication with the first inlet 113, and the second inlet 114 is located on the outer side the outlet of the first end 210 of the nozzle 200. The magnetic rotating mechanism 300 comprises an outer ring 310 and an inner ring 320 concentrically arranged on the inner side of the outer ring 310. The outer ring 310 and the inner ring 320 are installed at the housing 100 around the axis of the first chamber 111 of the housing 10 in a rotatable manner, wherein the inner ring 320 is rotatably connected to the second end 220 of the nozzle 200, for example, by a threaded connection. In order to protect the second end 220 of the nozzle 200, the housing 100 further comprises an end cover 120, which is provided at or near the second end 220 of the nozzle 200. The outer surface of the inner ring 320 and the inner surface of the outer ring 310 are respectively provided with magnets with opposite magnetic properties and the same quantity, and an extending portion 130 for sealing is provided between the inner ring 320 and the outer ring 310. One side of the extending portion 130 is fixedly connected to the body 110 of the housing 100, and the other side is detachably fixed to the end cover 120 of the housing 100. The guiding mechanism 400 is arranged between the housing 100 and the nozzle 200 to prevent the nozzle 200 from rotating around the axis of the first chamber 111 of the housing 100. As shown in FIGS. 1 and 4, the outer surface of the outer ring 310 is provided with a gear 311, and the outer ring 310 can maintain a transmission connection with a driving device, such as an external motor (not shown), through the gear 311.

When the outer ring 310 of the magnetic rotating mechanism 300 rotates when driven by an external motor, the magnetic field between the outer ring 310 and the inner ring 320 changes, so the inner ring 320 rotates together with the outer ring 310 under the magnetic force of the magnet. Driven by the inner ring 320, the nozzle 200 generates relative motion simultaneously, and is capable of only moving forward and backward along the axis direction of the first chamber 111 under the action of the guiding mechanism 400. During this period, the distance L from the first end 210 of the nozzle 200 to the inlet of the mixing section 112*b* of the second chamber 112 changes to cover operating conditions under various pressures. Specifically, when the compressor operates under high-pressure conditions, the L value should be large to ensure that the high-pressure fluid and low-pressure fluid can be fully mixed. Whereas, when the compressor operates under low-pressure conditions, the L value should be small to ensure subsequent pressure rise. In short, the distance L from the first end 210 of the nozzle 200 to the inlet of the mixing section 112*b* of the second chamber 112 can be adjusted with changes in pressure. This can improve the operational efficiency of the ejector, further reduce the power consumption of the compressor, and thus improve the operational efficiency of the entire refrigeration system.

Referring to FIGS. 5 to 8, the guiding mechanism 400 may comprise: a sliding groove 410 provided on the sidewall of the first chamber 111 and extending along the axis direction of the first chamber 111; a sliding body 420 capable of moving along the sliding groove 410; and a recess 430 provided on the outer sidewall of the nozzle 200 for partially accommodating the sliding body 420, wherein the shape of the recess 430 matches the shape of a portion of the sliding body 420 extending into the recess 430. When the inner ring 320 drives the nozzle 200 to rotate, the sliding body 420 creates constraints in the radial direction of the nozzle 200, thus preventing the nozzle 200 from rotating around the axis of the first chamber 111 and forcing it to only move linearly along the axis direction of the first chamber 111. For example, the sliding body 420 can be in the form of a ball, the recess 430 has a hemispherical concave surface that matches the ball, and the sliding groove 410 has a semi-circular cross-section. For another example, the sliding body can be in the form of a square block, the recess is a square groove that matches the block, and the sliding groove has a square cross-section. For yet another example, the sliding body can be in the form of a cylinder, the recess is a cylindrical groove that matches the cylinder, and the sliding groove has a semi-circular cross-section. It is easy to understand that the length of the sliding groove 410 is usually designed to be slightly larger than the distance L from the first end 210 of the nozzle 200 to the inlet of the mixing section 112*b* of the second chamber 112.

Figure 9:
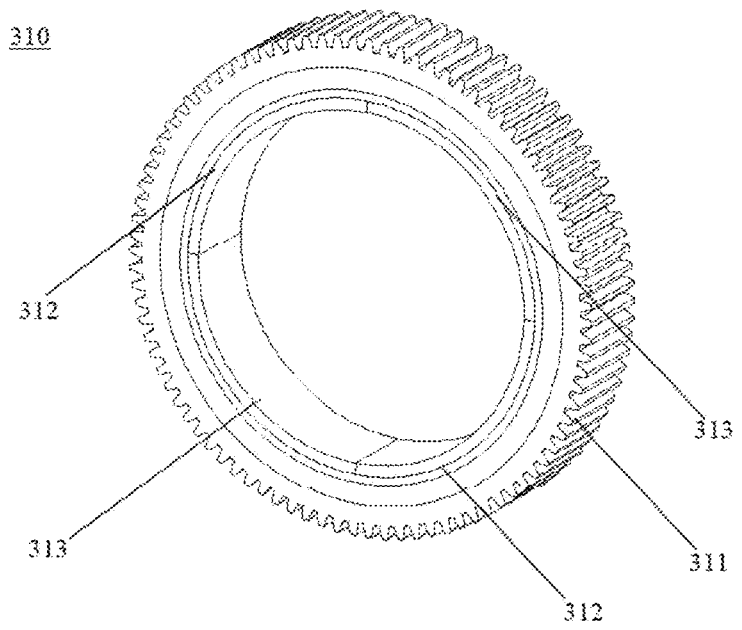
FIG. 9 illustrates an exemplary three-dimensional structural diagram of the outer ring of the magnetic rotating mechanism of the ejector according to the present invention.
Figure 10:
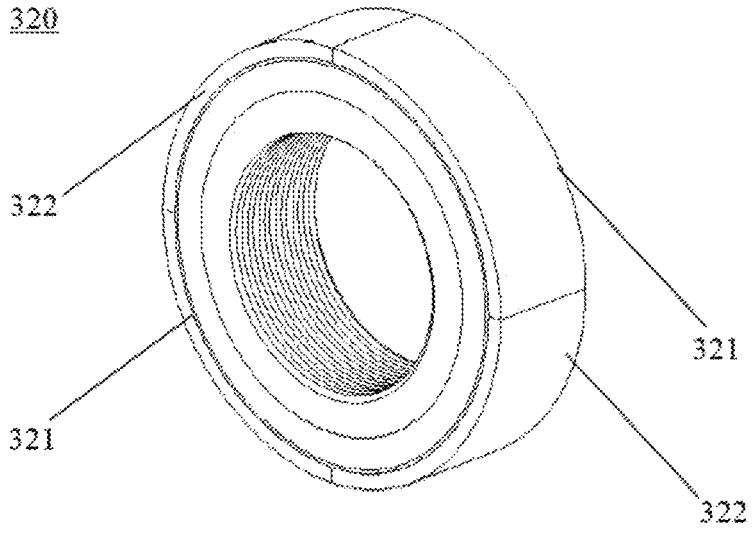
FIG. 10 illustrates an exemplary three-dimensional structural diagram of the inner ring of the magnetic rotating mechanism of the ejector according to the present invention.
Figure 11:
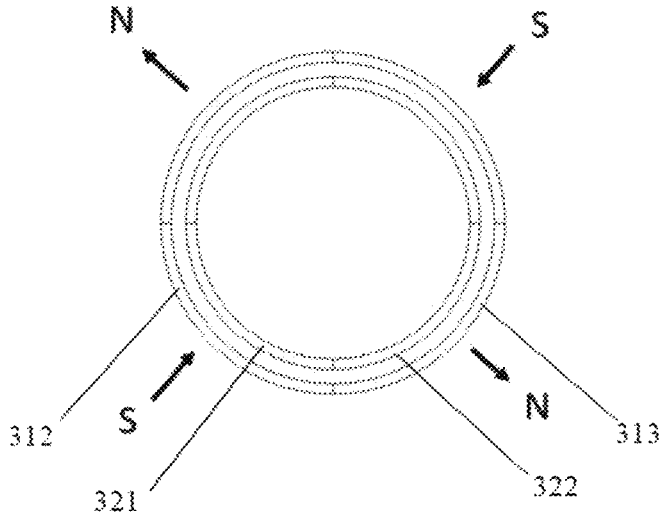
FIG. 11 illustrates an exemplary structural diagram of a magnetic rotating mechanism with four pairs of magnets of an ejector, with the outer and inner rings omitted, according to the present invention.
Figure 12:
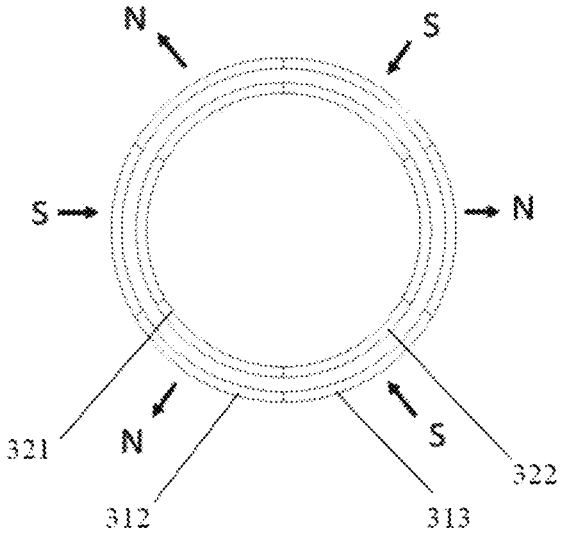
FIG. 12 illustrates an exemplary structural diagram of a magnetic rotating mechanism with six pairs of magnets of an ejector, with the outer and inner rings omitted, according to the present invention.
Figure 13:
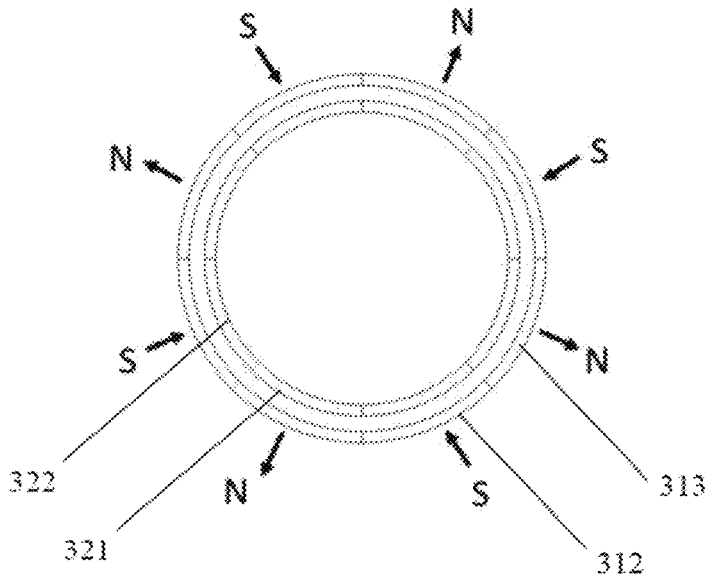
FIG. 13 illustrates an exemplary structural diagram of a magnetic rotating mechanism with eight pairs of magnets of an ejector, with the outer and inner rings omitted, according to the present invention.
Figure 14:
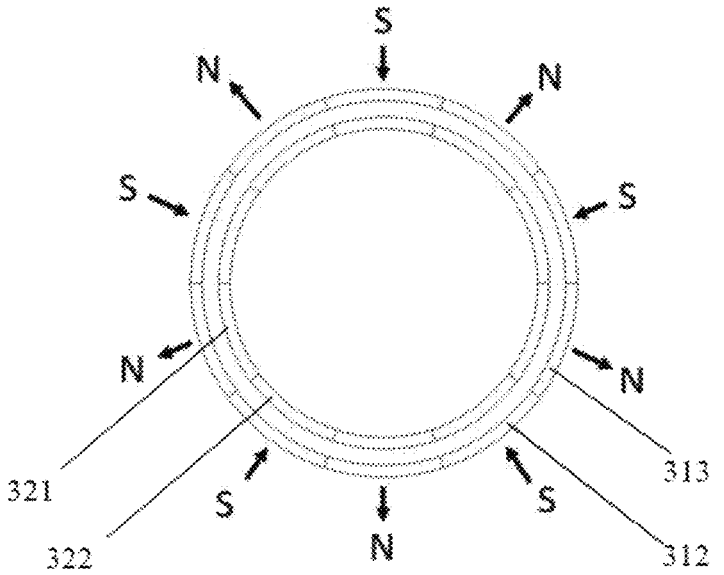
FIG. 14 illustrates an exemplary structural diagram of a magnetic rotating mechanism with ten pairs of magnets of an ejector, with the outer and inner rings omitted, according to the present invention.

The specific structure of the magnetic rotating mechanism 300 is described in detail below in conjunction with FIGS. 9 to 10. The inner surface of the outer ring 310 is provided with first magnets 312 and second magnets 313, where the first magnets 312 and the second magnets 313 are alternately connected in sequence. The magnetic property of the first magnets 312 is opposite to that of the second magnets 313 (i.e., one direction of the center of the circle facing outward is N-pole, and the other direction towards the center of the circle is S-pole; or vice versa), and the quantity of the first magnets 312 and that of the second magnets 313 are the same, which are respectively two. The outer surface of the inner ring 320 is provided with third magnets 321 and fourth magnets 322, where the third magnets 321 and the fourth magnets 322 are alternately connected in sequence. The magnetic property of the third magnets 321 is opposite to that of the fourth magnets 322 (i.e., one direction of the center of the circle facing outward is N-pole, and the other direction towards the center of the circle is S-pole; or vice versa), and the quantity of the third magnets 321 and that of the fourth magnets 322 are the same, which are respectively two. That is to say, one of the first magnets 312 and the second magnets 313 on the outer ring 310 corresponds one-to-one and is arranged in pairs with the other of the third magnets 321 and the fourth magnets 322 on the inner ring 320, as shown in FIG. 11. Based on the above, when the outer ring 310 rotates, the magnetic field of the four pairs of magnets between the inner ring 320 and the outer ring 310 changes, thus causing the inner ring 320 to rotate under the action of magnetic force. Of course, it is readily appreciated by those skilled in the art that the quantity of the first magnets 312, the second magnets 313, the third magnets 321, and the fourth magnets 322 is not limited to two, and can be three, four, five, or more. That is to say, six pairs of magnets, eight pairs of magnets, ten pairs of magnets, or more can be arranged between the inner ring 320 and the outer ring 310 (see FIGS. 12 to 14). In addition, the first magnets 312 and the second magnets 313 can be fixed on the inner surface of the outer ring 310 by bonding, riveting, or threaded connection etc., and the third magnets 321 and the fourth magnets 322 can be fixed on the outer surface of the inner ring 320 by bonding, riveting, or threaded connection etc. Furthermore, the size and shape of the first magnet 312 and the second magnet 313 can be designed to be the same, and the size and shape of the third magnet 321 and the fourth magnet 322 can be designed to be the same, thereby reducing production costs.

Figure 15:
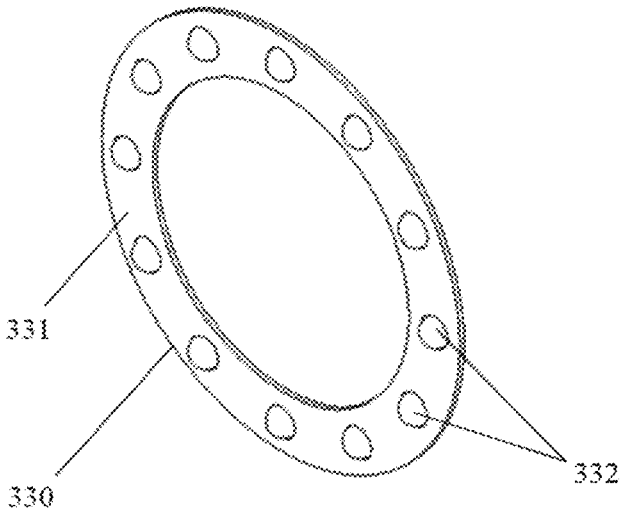
FIG. 15 illustrates an exemplary structural diagram of the first retaining ring of the magnetic rotating mechanism of an ejector according to the present invention.

In the aforementioned magnetic rotating mechanism 300, first retaining rings 330 are respectively provided on both sides of the outer ring 310 to prevent the outer ring 310 from moving axially, and to constrain the outer ring 310 radially, so that the outer ring 310 can only rotate around its axis. As shown in FIG. 15, the first retaining ring 330 comprises a first annular body 331 and a plurality of first balls 332, wherein the first annular body 331 is provided between the outer ring 310 and the housing 100, and the plurality of first balls 332 are fixed on the first annular body 331 in a rotatable manner. Specifically, the first annular body 331 of the first retaining ring 330 on one side of the outer ring 310 is arranged between the outer ring 310 and the body 110 of the housing 100, while the first annular body 331 on the other side of the first retaining ring 330 of the outer ring 310 is arranged between the outer ring 310 and the end cover 120 of the housing 100. Similarly, second retaining rings 340 are respectively provided on both sides of the inner ring 320 to prevent the inner ring 320 from moving axially, and at the same time to constrain the inner ring 320 radially, so that the inner ring 320 can only rotate around its axis. The second retaining ring 340 comprises a second annular body and a plurality of second balls, wherein the second annular body is provided between the inner ring 320 and the housing 100, and the plurality of second balls are fixed on the second annular body in a rotatable manner. Specifically, the second annular body of the second retaining ring 340 on one side of the inner ring 320 is arranged between the inner ring 320 and the body 110 of the housing 100, while the second annular body of the second retaining ring on the other side of the inner ring 320 is arranged between the inner ring 320 and the end cover 120 of the housing 100. It can be seen that the first retaining ring 330 and the second retaining ring 340 play a role similar to that of a ball bearing.

As an example, the outer ring 310 and the inner ring 320 can be made of aluminum alloy or magnesium alloy. In addition, the housing 100 can be made of non-magnetic materials such as copper. In addition, the nozzle 200 can be made of stainless steel to prevent cavitation from occurring.

Referring again to FIGS. 5 and 7, for convenience of manufacture, one side of the extending portion 130 can be fixedly connected to the body 110 of the housing 100 through welding, riveting, or threaded connection etc., or can even be integrally formed with the body 110 of the housing 100. The other side of the extending portion 130 can be fixedly connected to the end cover 120 of the housing 100 through threaded connection to prevent high-pressure fluid inside the ejector 10 from leaking from the connection between the magnetic rotating mechanism 300 and the housing 100. In order to further improve the sealing effect, the extending portion 130 is provided with sealant to prevent leakage of high-pressure or low-pressure fluids. It should be noted that during the operation of the ejector, the pressure inside the ejector chamber is much higher than the ambient pressure (atmospheric pressure). In this case, the ejector according to the present invention, through an innovative design, by arranging a motor and other driving mechanisms outside the ejector, avoids refrigerant leakage and other problems that may be caused by components of the motor and other driving mechanisms.

Figure 8:
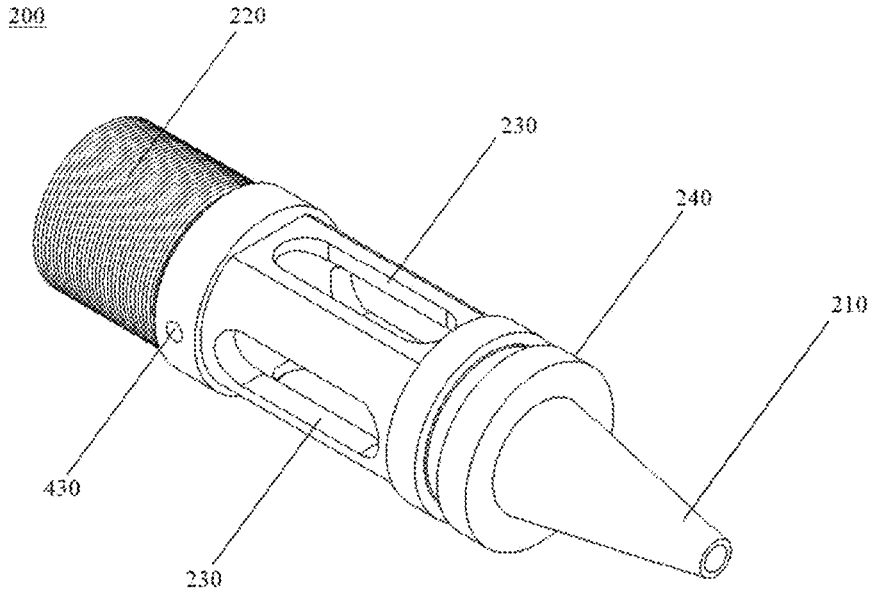
FIG. 8 illustrates an exemplary three-dimensional structural diagram of a nozzle of an ejector according to the present invention.

In the embodiment shown in FIGS. 4 and 8, the nozzle 200 is provided with four openings 230 for introducing high-pressure fluid, where the four openings 230 are uniformly distributed around the circumference of the nozzle 200. In addition, the hollow structure of the nozzle 200 has a reducing section 211 and an expanding section 212 near the first end 210, allowing the high-pressure fluid to be expanded and accelerated through the nozzle. The velocity is maximized at the outlet of the first end 210 of the nozzle 200, and a low-pressure area is formed between the outlet cross-section of the nozzle 200 and the inlet cross-section of the mixing section 112*b*. A pressure difference is formed at the end outlet of the nozzle, and under the effect of the pressure difference, the low-pressure fluid is sucked into the reducing section 112*a* of the second chamber 112 from the second inlet 114. In order to prevent the low-pressure fluid from entering the hollow structure of the nozzle 200 and mixing with the high-pressure fluid in advance, a protrusion 240 arranged circumferentially around the nozzle 200 is also provided on the outer sidewall of the nozzle 200.

In summary, the ejector of the present invention has a simple structure, low cost, and high reliability. By adjusting the position of the nozzle, the distance between the end outlet of the nozzle and the mixing chamber changes, thereby achieving optimal position adjustment under different operating conditions and ensuring system stability.

In addition, the present invention also provides a refrigeration system configured with the aforementioned ejector. The refrigeration system comprises a cooling tower, a chiller unit, a pumping device, etc., connected by pipelines, wherein the chiller unit is composed of components such as a compressor, a condenser, a throttling device, and an evaporator. As mentioned earlier, the aforementioned ejector can meet the needs of the compressor under various pressure conditions, further reducing the power consumption of the compressor and thereby improving the operational efficiency of the entire refrigeration system. Therefore, it is highly recommended to apply the aforementioned ejector to various refrigeration systems.

If terms such as "first" and "second" are used herein to limit components, those skilled in the art should be aware that the use of "first" and "second" is only for the convenience of describing and distinguishing components. Unless otherwise stated, the above terms do not have any special meanings.

In addition, as to the terms used to indicate positional relationships or shapes in any of the technical solutions disclosed in the present invention, unless otherwise stated, the implications thereof include states or shapes that are approximate, similar, or close to them. Any component provided by the present invention can be either assembled from multiple individual components or manufactured as a separate component using an integration process.

If terms such as "center", "longitudinal", "transverse", "front", "back", "left", "right", "vertical", "horizontal", "top", "bottom", "inside", "outside", etc. are used in the depiction of the present invention, the orientations or positional relationships indicated by the above terms are based on the orientations or positional relationships shown in the drawings. These terms are used merely for the convenience of describing the present invention and simplifying the description, rather than indicating or implying that the device, mechanism, component or element referred to must have a specific orientation, be constructed and operated in a specific orientation, so they cannot be understood as forming limitations on the scope of protection of the present invention.

Last, it should be noted that the above embodiments are only used to illustrate the technical solution of the present invention but not to limit it. Although the present invention has been described in detail with reference to preferred embodiments, those skilled in the art, however, should understand that the specific embodiments of the present invention can still be modified or some technical features can be equivalently substituted. Without departing from the spirit of the technical solution of the present invention, all of these modified embodiments or technical features used for equivalent substitution should fall within the scope of the claimed technical solution of the present invention.

What is claimed is:

1. An ejector, comprising:

a housing having a first chamber and a second chamber, wherein the first chamber is provided with a first inlet for introducing high-pressure fluid and a second inlet for introducing low-pressure fluid, and the second chamber is sequentially provided with a reducing section, a mixing section, and an expanding section along a direction of fluid movement;

a nozzle installed in the first chamber of the housing and is only capable of moving along an axis direction of the first chamber of the housing, wherein the nozzle has a first end and a second end, the first end of the nozzle extends into the reducing section of the second chamber, the nozzle has a hollow structure for maintaining fluid communication with the first inlet, and the second inlet is located outside an outlet of the first end of the nozzle;

a magnetic rotating mechanism, comprising an outer ring and an inner ring concentrically arranged on an inner side of the outer ring, where the outer ring and the inner ring are installed at the housing in a rotatable manner around an axis of the first chamber of the housing, wherein the inner ring is rotatably connected to the second end of the nozzle, an outer surface of the inner ring and an inner surface of the outer ring are respectively provided with magnets with opposite magnetic properties and the same quantity, and an extending portion for sealing is provided between the inner ring and the outer ring, where the extending portion is fixedly connected to the housing; and a guiding mechanism arranged between the housing and the nozzle to prevent the nozzle from rotating around the axis of the first chamber of the housing;

wherein, when the outer ring of the magnetic rotating mechanism rotates, a magnetic field between the inner ring and the outer ring changes, and the inner ring rotates under action of magnetic force, thereby driving the nozzle to move along the axis direction of the first chamber of the housing.

2. The ejector according to claim 1, wherein the guiding mechanism comprises:

a sliding groove arranged on a sidewall of the first chamber and extending along the axis direction of the first chamber;

a sliding body capable of moving along the sliding groove; and a recess arranged on an outer sidewall of the nozzle to partially accommodate the sliding body, wherein a shape of the recess matches a shape of a portion of the sliding body extending into the recess.

3. The ejector according to claim 2, wherein the sliding body is a ball, the recess has a hemispherical concave surface that matches the ball, and the sliding groove has a semi-circular cross-section; or the sliding body is a square block, the recess is a square groove that matches the block, and the sliding groove has a square cross-section; or the sliding body is a cylinder, the recess is a cylindrical groove that matches the cylinder, and the sliding groove has a semi-circular cross-section.

4. The ejector according to claim 1, wherein the inner surface of the outer ring is provided with first magnets and second magnets that are alternately connected in sequence, where magnetic property of the first magnets is opposite to that of the second magnets, and quantity of the first magnets and that of the second magnets are the same, which are at least two, respectively; and the outer surface of the inner ring is provided with third magnets and fourth magnets that are alternately connected in sequence, where magnetic property of the third magnets is opposite to that of the fourth magnets, and quantity of the third magnets and that of the fourth magnet are the same, which are at least two, respectively.

5. The ejector according to claim 4, wherein the first magnets and the second magnets are fixed on the inner surface of the outer ring by bonding, riveting, or threaded connection, and the third magnets and the fourth magnets are fixed on the outer surface of the inner ring by bonding, riveting, or threaded connection.

6. The ejector according to claim 4, wherein the first magnet and the second magnet have the same size and shape, and the third magnet and the fourth magnet have the same size and shape.

7. The ejector according to claim 1, wherein the housing comprises a body and an end cover, the extending portion is detachably fixed to a body of the housing or is integrally formed with the body of the housing, and the extending portion is detachably fixed to the end cover of the housing.

8. The ejector according to claim 1, wherein first retaining rings are respectively provided on both sides of the outer ring, where the first retaining ring comprises: a first annular body arranged between the outer ring and the housing; and a plurality of first balls fixed on the first annular body in a rotatable manner; and second retaining rings are respectively provided on both sides of the inner ring, where the second retaining ring comprises: a second annular body arranged between the inner ring and the housing; and a plurality of second balls fixed on the second annular body in a rotatable manner.

9. The ejector according to claim 1, wherein the outer surface of the outer ring is provided with a gear, and the outer ring is maintained in transmission connection with an external motor through the gear.

10. The ejector according to claim 1, wherein the nozzle is provided with four openings for introducing high-pressure fluid, where the four openings are uniformly distributed around a circumference of the nozzle.

11. The ejector according to claim 1, wherein the hollow structure of the nozzle has a reducing section and an expanding section near the first end.

12. The ejector according to claim 1, wherein the inner ring is in threaded connection with the second end of the nozzle.

13. A refrigeration system, wherein the refrigeration system is configured with an ejector according to claim 1.

14. An ejector, comprising:

a housing having a first chamber;

a nozzle installed in the first chamber capable of moving along an axis direction of the first chamber;

a magnetic rotating mechanism, comprising an outer ring and an inner ring concentrically arranged on an inner side of the outer ring, wherein the inner ring is rotatably connected to the second end of the nozzle, and an outer surface of the inner ring and an inner surface of the outer ring are respectively provided with magnets; and a guiding mechanism arranged between the housing and the nozzle to prevent the nozzle from rotating around the axis of the first chamber of the housing.

15. The ejector of claim 14, wherein the magnets of the inner surface of the outer ring are provided with first magnets and second magnets, wherein a magnetic property of the first magnets is opposite to that of the second magnets.

16. The ejector of claim 15, wherein the magnets of the outer surface of the inner ring are provided with third magnets and fourth magnets, wherein a magnetic property of the third magnets is opposite to that of the fourth magnets.

17. The ejector of claim 14, wherein first retaining rings are respectively provided on both sides of the outer ring, where the first retaining ring comprises: a first annular body arranged between the outer ring and the housing.

18. The ejector of claim 17, wherein a plurality of first balls fixed on the first annular body in a rotatable manner.

19. The ejector of claim 18, wherein second retaining rings are respectively provided on both sides of the inner ring, where the second retaining ring comprises: a second annular body arranged between the inner ring and the housing.

20. The ejector of claim 19, wherein a plurality of second balls fixed on the second annular body in a rotatable manner.

* * * * *